United States Patent [19]

Landreau

[11] 4,018,139

[45] Apr. 19, 1977

[54] ROTARY HYDRAULIC MACHINE

[75] Inventor: Jean Florent François Marcel Robert Landreau, Auzay, France

[73] Assignee: Societe Anonyme Francaise du Ferodo, Paris, France

[22] Filed: July 29, 1975

[21] Appl. No.: 600,183

[30] Foreign Application Priority Data

Aug. 8, 1974 France ..... 74.27514

[52] U.S. Cl. ..... 91/490

[51] Int. Cl.[2] ..... F01B 13/06

[58] Field of Search ..... 91/487, 490, 491, 481, 91/498

[56] References Cited

UNITED STATES PATENTS

| | | | |
|---|---|---|---|
| 3,168,006 | 2/1965 | Bennett | 91/490 |
| 3,199,460 | 8/1965 | Bush et al. | 91/487 |
| 3,320,902 | 5/1967 | Paschke | 417/510 |
| 3,663,124 | 5/1972 | Schultz | 91/491 |
| 3,777,624 | 12/1973 | Dixon | 91/488 |
| 3,782,245 | 1/1974 | Aldinger | 91/498 |

FOREIGN PATENTS OR APPLICATIONS

| | | | |
|---|---|---|---|
| 2,061,960 | 6/1972 | Germany | 91/490 |
| 29,932 | 6/1966 | Japan | 91/481 |
| 5,306 | 3/1914 | United Kingdom | 91/491 |

*Primary Examiner*—William L. Freeh
*Attorney, Agent, or Firm*—Young & Thompson

[57] ABSTRACT

The invention relates generally to rotary hydraulic machines of the kind comprising, in a casing, a rotatably-mounted shaft and a plurality of cylinder-piston units mounted radially in star around the shaft and co-operating with eccentric means so arranged as to impart a relative movement to each of said units in turn, conjointly with the rotation of the shaft, and also with fluid-circulation means so arranged that each of the cylinder-piston units are supplied with fluid in turn. The eccentric means may comprise an eccentric bearing surface provided on said shaft and co-operating with the cylinder-piston units supplied with fluid through conduits formed in the shaft, under the control of a distribution ring engaged on the eccentric surface. The cylinders of the units are oscillatably mounted, and controlled retention means prevent any driving action on the distribution ring by the eccentric surface.

16 Claims, 10 Drawing Figures

ROTARY HYDRAULIC MACHINE

The present invention relates generally to rotating hydraulic machines, of the kind comprising, in a casing, a rotatably-mounted shaft and a plurality of cylinder-piston unit assemblies arranged radially in star round the said shaft, in co-operation on the one hand with off-centering means established in such manner that the cylinder-piston units of each of the said assemblies have each in turn a relative movement with respect to each other in conjunction with the rotation of the shaft, and on the other hand, fluid-circulation means established in such manner that each of the cylinder-piston unit assemblies is also supplied with fluid in turn.

Depending on the circulation of this fluid, a rotating hydraulic machine of this kind constitutes a pump or a motor.

The off-centering means may indifferently be constituted by the internal periphery of an eccentric ring coupled to the casing and arranged round the cylinder-piston unit assemblies, or they may be constituted by an eccentric bearing surface of a rotating shaft surrounded by the cylinder-piston unit assemblies, these two arrangements being technically equivalent with respect to the object sought and to the result obtained.

In rotary hydraulic machines of this type, it has been proposed to effect individually the supply of fluid to each of the cylinder-piston assembly units.

Although constructions of this type are perfectly satisfactory, they have however a certain complexity.

It has also been proposed to effect the supply of fluid to the cylinder-piston assembly units by inlet and outlet conduits formed in the shaft parallel to the axis of the shaft, the said conduits opening respectively into inlet and outlet cavities which are formed circularly and in sequence one after the other at the periphery of the shaft, in the part of this latter surrounded by the cylinder-piston assembly units, and which are separated circularly from each other by change-over bosses in cooperation with a distribution ring engaged on the shaft and interposed between this latter and the cylinder-piston assembly units which surround it, the said ring being provided with a substantially radial passage facing each of the said assemblies for communication in turn of these latter with the inlet conduit and with the outlet conduit.

Not only does this arrangement lead to a simplification of the fluid-supply system, but it also permits an advantageous separation between the rotational movements which take place between the ring and the shaft, and the alternating movements which take place between the cylinder-piston assembly units and the said ring.

It is however necessary in this case to ensure suitable retention of the ring with respect to the shaft which it surrounds, in order to prevent any driving of this ring by the said shaft.

In a known construction of this type, each piston is in contact with the ring by a flat surface, and is prevented from making any movement laterally with respect to the casing, so that the ring is thus suitably held by the single fact of the plane contact which it has with each of the pistons.

However, due to the fact of the associated off-centering means, there is relative displacement of the ring with respect to each of the pistons transversely with regard to such a piston, so that each of the pistons, thus urged transversely by the ring with an alternating movement, tends to cause ovality of the cylinder in which it is mounted, and in practice in order to prevent this ovalization, special and relatively complicated arrangements must be provided.

In another also known arrangement, this ovalization of the cylinders by the corresponding pistons is prevented by ensuring parallel displacement of the cylinders and the pistons, the ring being held in position by the sole fact that it is then coupled to the said cylinders.

This results however in appreciable complication of the whole assembly.

Now it has already been proposed, but in constructions for the individual supply of cylinder-piston assembly units, to mount each of these cylinders in the casing oscillatably about an axis substantially parallel to the shaft, or to mount them on a universal joint located at the end of the cylinder, which makes it possible to prevent ovalization of the cylinder by the piston which is engaged in that cylinder.

The present invention has in a general manner for its object to propose an adaptation of such an arrangement to rotary hydraulic machines with supply through the shaft.

More precisely, the present invention has for its object a rotary hydraulic machine which is of the kind comprising a shaft rotatably mounted in a casing and having radially an eccentric bearing surface, and a plurality of cylinder-piston assembly units arranged radially in star around the said eccentric bearing surface of the said shaft, and each individually-mounted oscillatably in the casing about an axis substantially parallel to the said shaft, so that the cylinder-piston units of each of the said assemblies have in turn a relative movement with respect to each other, in conjunction with the rotation of the shaft, in cooperation on the one hand with inlet and outlet conduits formed in the said shaft and parallel to the axis of the shaft for the circulation of the hydraulic fluid, the said conduits opening respectively into inlet and outlet cavities which are formed circularly one following the other at the periphery of the eccentric bearing surface of the shaft and which are circularly separated from each other by change-over bosses, and on the other hand with a distribution ring engaged on the eccentric bearing surface of the shaft and interposed between the said eccentric bearing surface and the cylinder-piston assembly units which surround this latter, the said ring being provided substantially radially with a passage facing each of the said assemblies for communication in turn of these latter with the inlet conduit and with the outlet conduit, and controlled retaining means being associated with the said ring so as to oppose any driving of this latter by the eccentric bearing surface on which it is engaged, this rotary hydraulic machine being characterized in that the said controlled retaining means comprising on the one hand at least one annular end-plate disposed transversely around the shaft and keyed for rotation with respect to any one of the casing-distribution ring members, and on the other hand at least two retaining dowel-pins which are carried by the other of the said casing-distribution ring members and which are each individually engaged in guiding holes provided for that purpose in the said end-plate. By virtue of this arrangement, the rotary hydraulic machine according to the invention permits an advantageous conjunction of the arrangement of an axial supply common to all the cylinder-piston assembly units and the arrangement of a oscillating mounting of the cylinder of each of these assemblies, which prevents in a simple manner any ovalization of such a cylinder.

The characteristic features and advantages of the invention will furthermore be brought out in the description which follows below by way of example, reference being made to the accompanying diagrammatic drawings, in which:

FIG. 1 is a view in axial section of a rotary hydraulic machine according to the invention, taken along the broken line I—I of FIG. 3;

The left-hand portion of FIG. 2 is a view in transverse section of this rotary hydraulic machine, taken along the line IIA—IIA of FIG. 1, while the right hand portion represents a view in transverse section of this same rotary hydraulic machine, taken along the line IIB—IIB of FIG. 1;

These drawings illustrate the application of the invention to the construction of a hydraulic motor.

Figure 1:
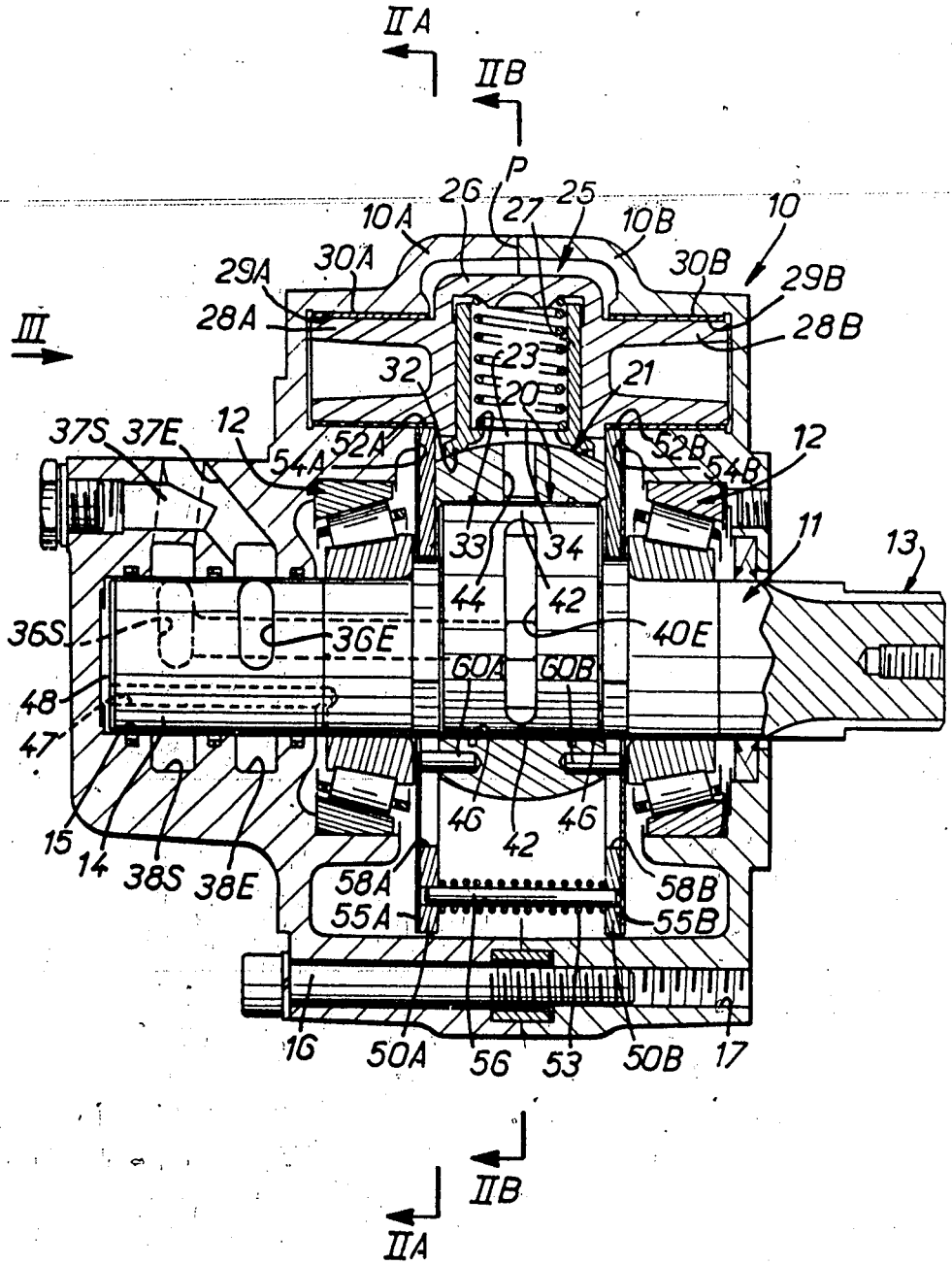
Figure 2:
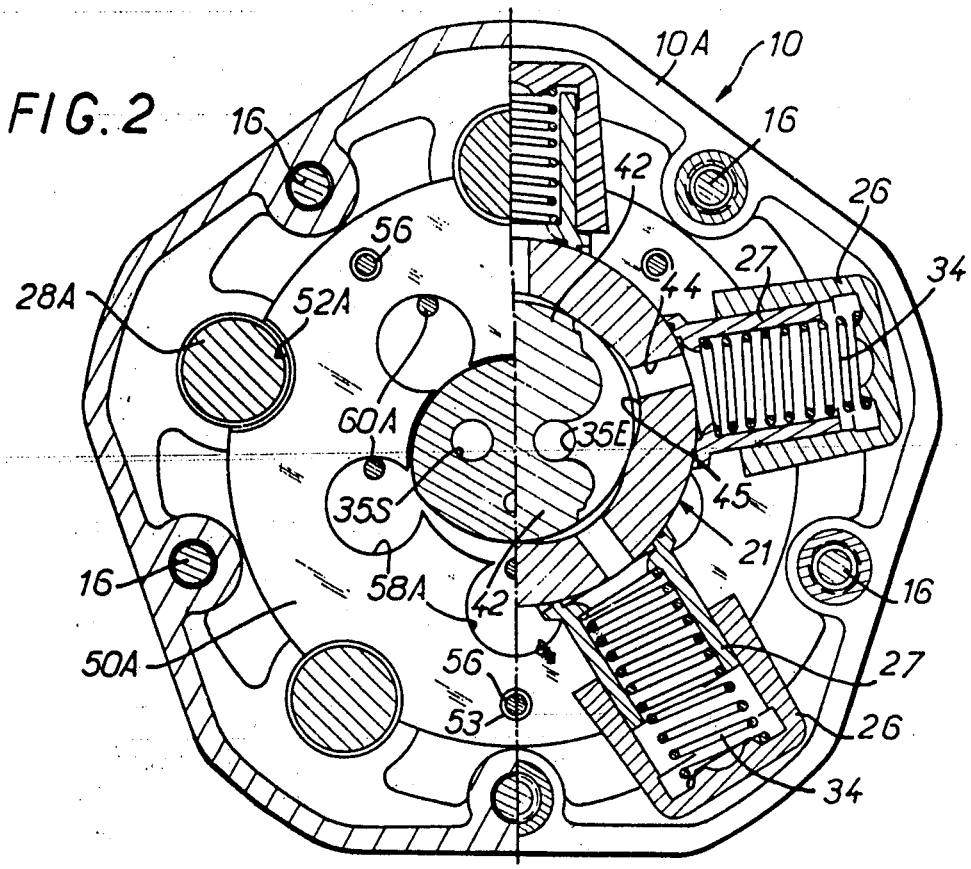
Figure 3:
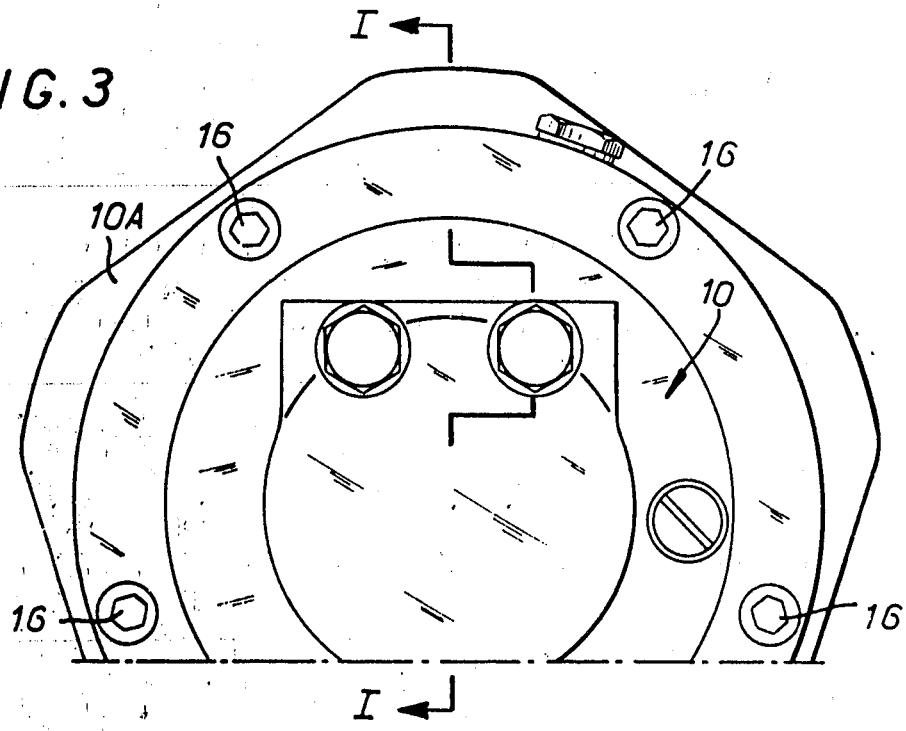
FIG. 3 is a partial end view of this rotary hydraulic machine taken in the direction of the arrow III of FIG. 1.

According to the form of embodiment illustrated in FIGS. 1 to 3, this hydraulic motor comprises, in a casing 10, a shaft 11 which is rotatably mounted between bearings 12, and of which one splined extremity 13 projects from the said casing 10, the other extremity 14 of the shaft 11 remaining confined inside the casing, in a closed housing 15 formed in this casing.

In practice, the casing 10 is formed by two shells 10A, 10B facing each other along a common junction plane P substantially transverse with respect to the shaft 11, and fixed to each other by means of threaded tie-rods 16 engaged in screwed holes 17 formed in one of them, parallel to the axis of the shaft 11.

The free extremities of these screwed holes 17 may advantageously serve for fixing the casing 10 to a support of any kind (not shown in the drawings).

In its central portion, the shaft 11 has an eccentric cylindrical bearing surface 20 on which is engaged a distribution ring 21 provided for that purpose with a cylindrical internal surface complementary to the eccentric bearing surface 20 of the shaft 11. In the example shown, the external surface 23 of the distribution ring 21 is spherical.

The casing 10 further contains a plurality of assemblies 25 which each comprise a cylinder member 26 and a piston member 27 movably mounted axially in the corresponding cylinder member, and which are uniformly distributed radially in star around the eccentric bearing surface 20 of the shaft 11, and therefore in practice around the distribution ring 21 engaged on this eccentric bearing surface.

In the example shown, there are thus five assemblies 25 of cylinder-piston units.

The cylinder 26 of each of these assemblies is mounted oscillatably in the casing 10 about an axis substantially parallel to the shaft 11, and is provided for that purpose with two trunnions 28A, 28B pivotally mounted in housings 29A, 29B provided for that purpose in the shells 10A, 10B which constitute the casing 10, with the interposition of sleeve bearings 30A, 30B.

In the example shown, a cylinder 26 of this kind is blind, and the piston 27 associated with it is tubular.

The free extremity of this piston 27 is provided with a spherical supporting surface 32, in contact with the distribution ring 21. It is further provided internally with a shoulder 33 for supporting a spring 34 which, additionally supported against the bottom of the corresponding cylinder 26, elastically urges the piston 27 in the direction of the distribution ring 21 so as to maintain the contact between this piston and this ring.

Hydraulic distribution means are further provided, and these means comprise an inlet conduit 35E and an outlet conduit 35S formed in the shaft 11 substantially parallel to its axis.

At the internal extremity 14 of this shaft, these inlet and outlet conduits are in communication with cavities 36E, 36S formed at the periphery of the shaft 11 and displaced axially with respect to each other along the said shaft.

The housing 15 of the casing 10 in which is engaged the external extremity 14 of the shaft 11, is provided, facing the inlet and outlet cavities 26E and 26S of this shaft, with annular inlet grooves 38E and outlet grooves 38S which, through conduits 27E, 37S formed in the casing 10, are intended to be coupled to any source of fluid circulation (not shown).

At the level of the eccentric bearing surface 20, the internal inlet and outlet conduits 35E, 35S of the shaft 11 open respectively into inlet and outlet cavities 40E, 40S which are formed circularly in sequence with each other on the internal periphery of the said eccentric bearing surface 20, in the central zone of this latter, and which are circularly separated from each other by change-over bosses 42, the said bosses resulting in practice from what remains at this level of the eccentric bearing surface 20, taking account of the cavities 40E, 40S which are formed in it.

The distribution ring 21 is conjointly provided in its central zone with passages 44 which each extend substantially radially and which are each respectively arranged facing an assembly 25 of cylinder-piston units for the supply of this latter.

Level with each of these passages 34, the internal periphery of the distribution ring 21 has a bowl 45 which flares outwards circumferentially on each side of the outlet of the corresponding passage 44, and the developed circumferential length of which will hereinafter be indicated by D.

Furthermore, in the example shown, the internal periphery of the distribution ring 21 is provided transversely, on each side of the passages 44, with grooves 46m the function of which will be explained later.

Similarly, and for reasons which will subsequently become apparent, the internal extremity 14 of the shaft 11 is provided with a conduit 47 which extends substantially parallel to the axis of this shaft and which is intended to cause the volume 48 of the casing 10 confined between the internal extremity 14 of the shaft 11 and the bottom of the blind housing 15 in which this shaft is engaged, to communicate with the remainder of the casing 10.

In addition, controlled retention means are associated with the distribution ring 21 so as to oppose any driving of this latter by the eccentric bearing surface 20 of the shaft 11 on which it is engaged.

In the form of embodiment shown in FIGS. 1 to 3, these controlled retention means comprise two annular end-plates 50A, 50B, arranged transversely round the shaft 11, on each side of the eccentric bearing surface 20 of this shaft and keyed against rotation with said shaft.

In order to do this, these end-plates 50A, 50B, are provided at their periphery with notches 52A, 52B by means of which they are engaged in the trunnions 28A, 28B of the cylinders 26.

Spacing springs 53 acting on the end-plates 50A, 50B and holding each of these latter in contact with the shoulder 54A, 54B of the casing 10, with the interposition of the full backing plate 55A, 55B, the function of which will become apparent later.

These spacing springs 53 are each engaged on a holding rod 56 fixed between one of the end-plates 50A, 50B and the other.

In the vicinity of their internal periphery, the end-plates 50A, 50B, are provided with substantially circular openings 58A, 58B.

In the example shown, each end-plate 50A, 50B comprises as many openings 58A, 58B as there are cylinder-piston assembly units 25, and, like these latter, these openings are uniformly distributed circularly.

At the same time, the distribution ring 21 carries parallel to the shaft 11, as many supporting dowel pins 60A, 60B as there are cylinder-piston assembly units 25, and each of these pins 60A, 60B is engaged in an opening 58A, 58B of the corresponding end-plate 50A, 50B, one of these pins coming into contact with such an opening for its guiding.

In operation and in the case of a motor, fluid under pressure is introduced into the rotary hydraulic machine according to the invention through the conduit 37E provided for that purpose.

Through the cavity 36E of the internal extermity 14 of the shaft 11, then the axial conduit 35E of this shaft, and finally the cavity 40E of its eccentric bearing surface 20, this fluid under pressure is permitted to pass into those of the cylinder-piston assembly units 25 for which the corresponding passages 34 of the distribution ring 21 come opposite to the inlet cavity 40E of the said eccentric bearing surface.

Thus there may be two or three assemblies 25 supplied with fluid under pressure, while the other three or two are conjointly in connection with the outlet cavity 40S of the eccentric bearing surface 20 of the shaft 11, the cavities 40E, 40S of this eccentric bearing surface being separated by the change-over bosses 42 which ensure adequate fluid-tightness between the corresponding chambers.

For each of the cylinder-piston assembly units 25 thus supplied with fluid under pressure, this fluid applies on the internal extremity of the corresponding piston 27 a force which this piston transmits by the distribution ring 21 to the eccentric bearing surface 20 of the shaft 11.

Due to the actual fact of the eccentricity of this bearing surface, this results in a couple for driving the said shaft.

During the course of this resulting rotation of the shaft 11, the other cylinder-piston assembly units 25 are successively supplied with fluid under pressure, following the process described above, which maintains and ensures the rotation of the shaft 11.

The grooves 46 provided in the internal peripheral bearing surfaces of the distribution ring 21 make it possible to ensure under all circumstances adequate lubrication of the interface between this distribution ring and the eccentric bearing surface 20 of the shaft 11 on which it is engaged.

In fact, while this lubrication does not present any problem level with the inlet cavity 40E of the eccentric bearing surface 20, which is supplied with fluid under pressure, so that there is established between the central portion of the eccentric bearing surface 20 and the extremities of this latter, a pressure gradient sufficient to ensure suitable lubrication of the interface between this eccentric bearing surface and the distribution ring 21, this is not the case at the level of the outlet cavity 40S of the eccentric bearing surface 20, this cavity only collecting fluid at low pressure By collecting fluid at medium pressure at the level of the inlet cavity 40E of the eccentric bearing surface 20, the grooves 46 make it possible to transfer this fluid to the level of the outlet cavity 40S of this bearing surface diametrically opposite to that preceding, so that a pressure gradient can also be established on each side of such a groove in the interface to be lubricated.

An identical result would also of course be obtained if the grooves 46 were formed, not at the internal periphery of the distribution ring 31, but at the outer periphery of the eccentric bearing surface 20.

The dimensioning of the cavities 40E and 40S and the spacing apart of the grooves 46 are such that the pressure field which they establish approximately compensates for the forces (actions) applied by the pistons on the ring 31.

In practice, matters are so arranged that there is a slight under-compensation of the actions, in such manner that the contact of the ring 21 with the eccentric bearing surface is located in the zone of the cavity 40 subjected to the high pressure. Under these conditions:

the contact is perfectly lubricated;

the leakage is a minimum due to the fact of minimum clearance.

Furthermore, the conduit 47 provided in the internal extremity 14 of the shaft 11 makes it possible to avoid packing of the space 48 confined by this shaft in the casing 10, by fluid under pressure possibly arising between this shaft and the casing 10 in the direction of the said space 48.

Conjointly, the holding pins 60A, 60B, carried by the distribution ring 31, supported on the side of the openings 58A, 58B in which they are engaged, ensure maintenance of the distribution ring 21 such as to permi this latter to ensure in a suitable manner the change over from high-pressure inlet to low-pressure outlet o the cylinder-piston assembly units 25 at the correc moment.

In fact, the openings 58A, 58B having a circula contour, each of the retention pins 60A, 60B of th distribution ring 21 describes during the course of cycle of rotation of the shaft 11 an eccentric circl equal to the eccentric circle of the eccentric bearin surface 20 of the shaft 11, and therefore of the distribution ring 21, with respect to the axis of this shaft 11.

It is obvious that in this respect one single end plate 50A or 50B would be sufficient on a single transverse face of the distribution ring 21, and/or that for any one of these end-plates 50A, 60B, there would only be necessary two retention pins 60A or 60B, arranged in diametrically-opposite positions.

As will have been understood, the backing plates 55A, 55B, which line the end-plates 50A, 50B prevent the holding pins 60A, 60B of the distribution ring 21 from escaping from this latter, these pins coming into abutment against the said backing-plates at their free extremities.

Preferably and as shown, the change-over bosses 42 are shaped symmetrically with respect to the axial plane of symmetry of the eccentric bearing surface 20, of which they form part of the periphery, and their developed circumferential length D' from one cavity 40E, 40S of this eccentric bearing surface to the other, is greater than the corresponding developed circumferential length D of the bowls 45 formed on the internal surface of the distribution ring 21 at the outlet of the radial passages 44 of this ring.

In this way, before its change-over on the inlet cavity 40E under pressure of the eccentric bearing surface 20 of the shaft 11, each cylinder-piston assembly unit 25 is isolated for a certain time from the low-pressure outlet cavity 40S of this eccentric bearing surface.

During the course of this isolation period, the corresponding piston 27 continues its travel and this results, from the sole fact of the movement of this piston, in a relatively gradual build-up of pressure in the enclosed space inside the corresponding cylinder.

Thus the application of pressure in each cylinder-piston assembly unit 25 is not carried out abruptly by all or nothing, and this is also true of the discharge of this pressure.

This results in an advantageous modulation of the operation of the unit.

Figure 4:
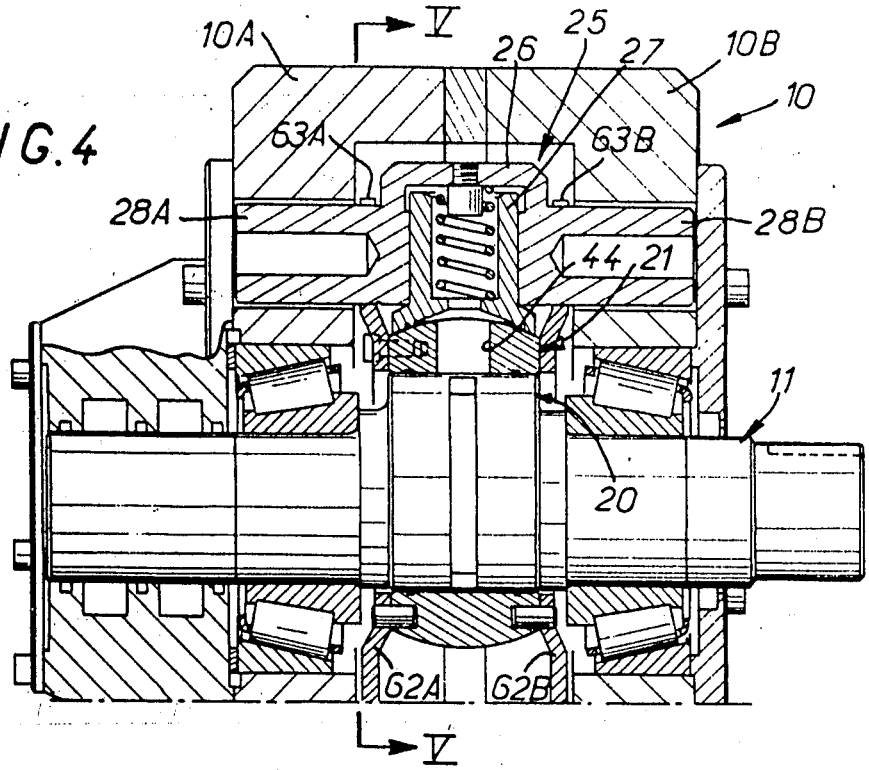
FIG. 4 is a partial view similar to FIG. 1 and relates to an alternative form of construction.
Figure 5:
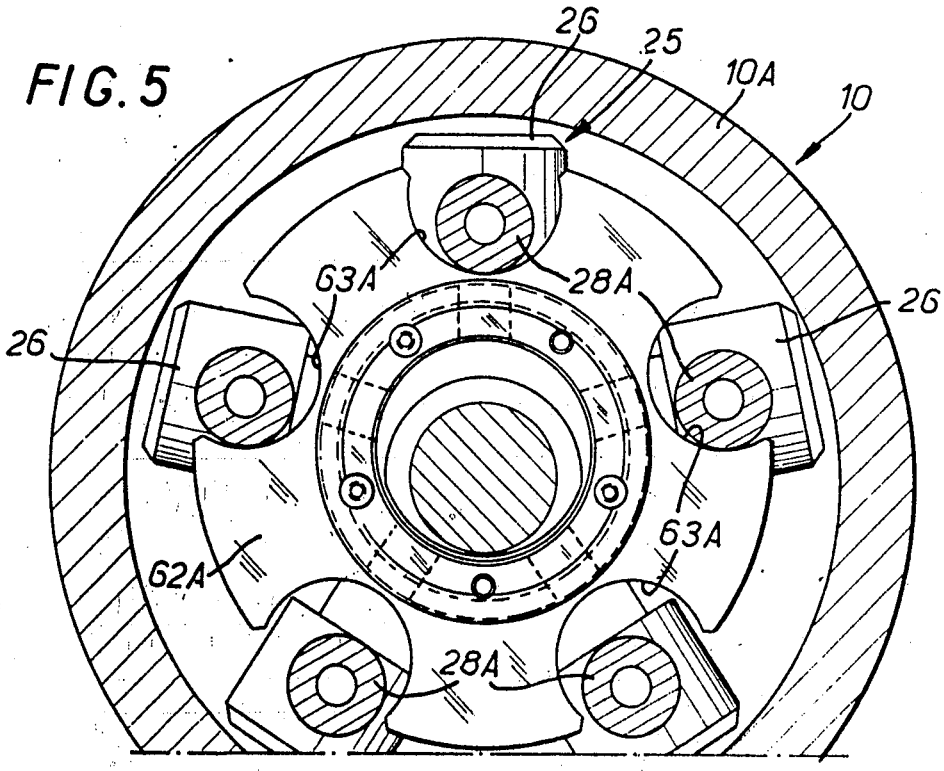
FIG. 5 is a partial view in transverse section of this alternative form, taken along the line V—V of FIG. 4.

According to the alternative form of construction illustrated in FIGS. 4 and 5, the controlled retention means for the distribution ring 21 comprise at least one and in practice two end-plates 62A, 62B carried laterally by the said ring, transversely with respect to the shaft 11, each of these end-plates 62A, 62B being provided at its internal periphery with guiding openings 63A, 63B, by which they are engaged on the trunnions 28A, 28B of the cylinder-piston assembly units 25.

These trunnions 28A, 28B, play in this respect the part of retention pins fixed on the casing 10, these retention pins extending parallel to the shaft 11.

It will be clear that other retention devices fixed on the casing 10 could be employed, as described below with reference to FIGS. 6 and 7, but for certain applications at least, it is advantageous to take advantage of the existence of the trunnions 28A, 28B, which reduces the number of parts required.

In addition, these trunnions 28A, 28B are located on a diameter greater than the retention pins 60A, 60B of the previous version, which minimises the importance of friction.

However this may be, the retention pins constituted by the trunnions 28A, 28B co-operate with the end-plates 62A, 62B in the same way as those described with reference to FIGS. 1 to 3 for the retention pins 60A, 60B which, in this form of embodiment, co-operate with the fixed end-plates 50A, 50B.

Figure 6:
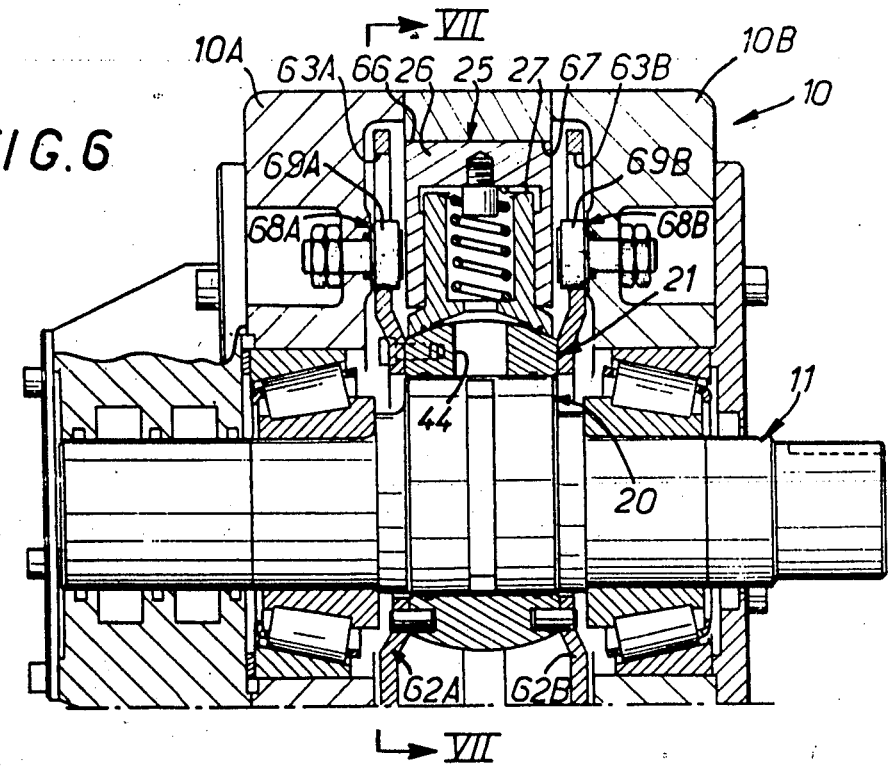
FIGS. 6 and 7 are views respectively similar to those of FIGS. 4 and 5, and relate to another alternative form of construction of the rotary hydraulic machine according to the invention.
Figure 7:
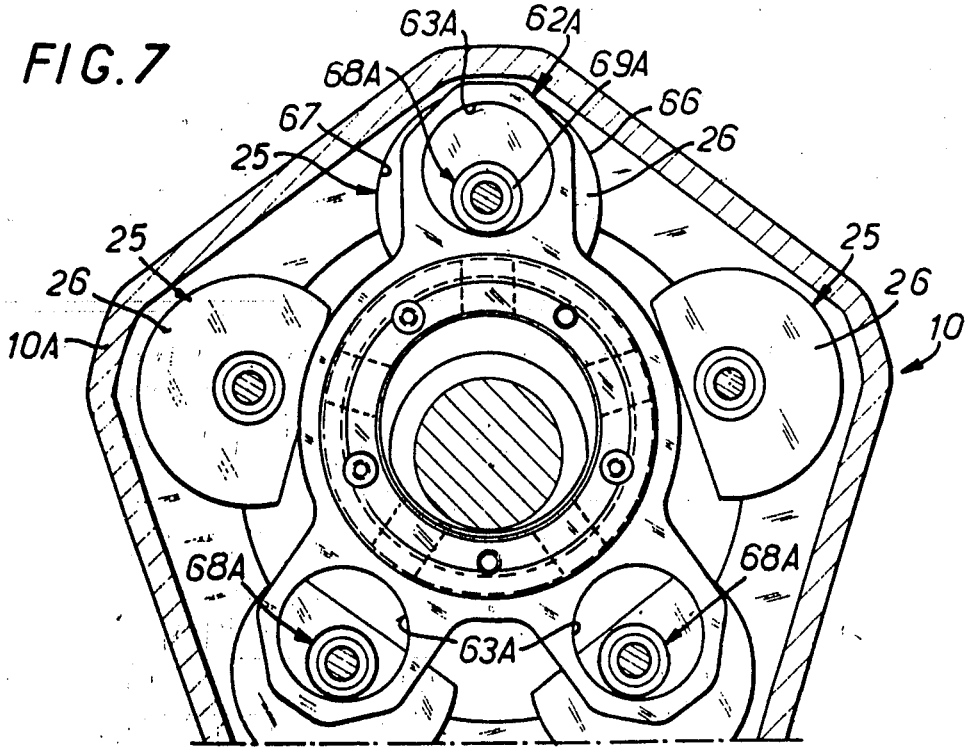

In accordance with the alternative form of embodiment shown in FIGS. 6 and 7, the cylinder 26 of each cylinder-piston assembly unit 25 is not provided with trunnions, this cylinder being directly mounted pivotally by its base 66 in the casing 10. Such a base 66 forms in fact a convex cylindrical generator surface parallel to the axis of the shaft 11 and is fitted into a complementary concave cylindrical surface 67 provided for that purpose in the casing 10.

In this case, the retention pins provided on the casing 10 for retaining the end-plates 62A, 62B form parts independent from the cylinders 26. These pins 68A, 68B have cylindrical heads 69A, 69B fixed by screwing on the casing 10.

The cylindrical heads 69A, 69B of these dowel pins are engaged in the openings 63A, 63B of the end-plates 62A, 62B, and in the example shown the latter have a closed contour.

In order to reduce friction, the heads 69A, 69B of the pins 68A, 68B may be surrounded with ball bearings; the same condition may apply to the pins 60A, 60B of the form of embodiment illustrated in FIGS. 1 to 3, or for the trunnions 28A, 28B of the form of embodiment shown in FIGS. 4 and 5.

It has furthermore been found that during the change-over of a cylinder-piston assembly unit 5 from a communication with the outlet cavity 40S of the eccentric bearing surface 20 of the shaft 11, which is at low pressure, to a communication with the inlet cavity 40E of this eccentric bearing surface, which is at high pressure, the hydraulic and mechanical thrusts which are applied on each side of the ring, on the internal surface of this ring and on its external surface, are respectively subject to substantial variations, especially due to the fact that there are alternately two or three of such assemblies simultaneously connected to any one of the said cavities.

Figure 8:
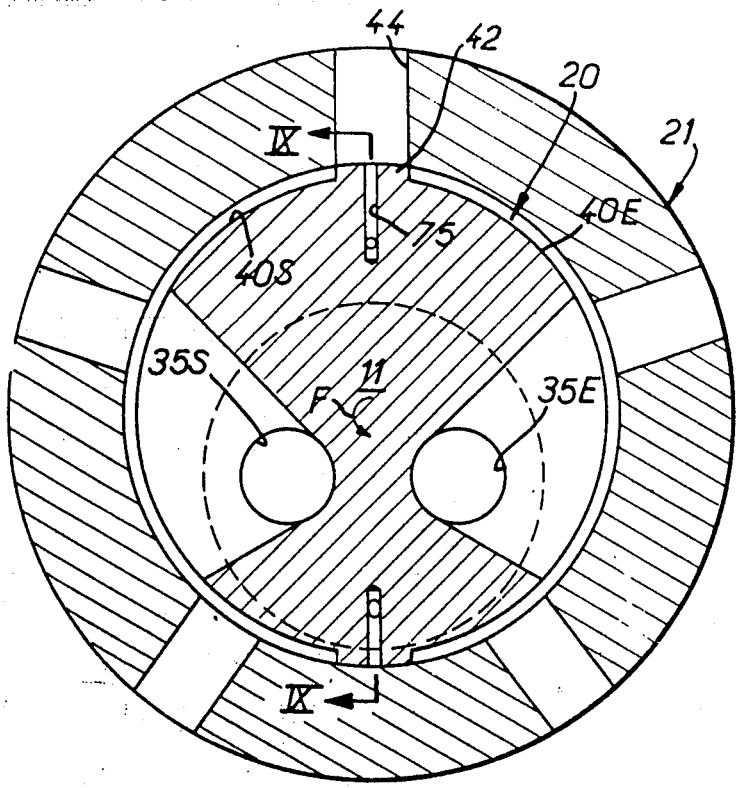
FIG. 8 is a diagrammatic view in partial transverse section of another alternative form of construction, and more particularly of the eccentric bearing surface provided on the shaft of this alternative form.
Figure 9:
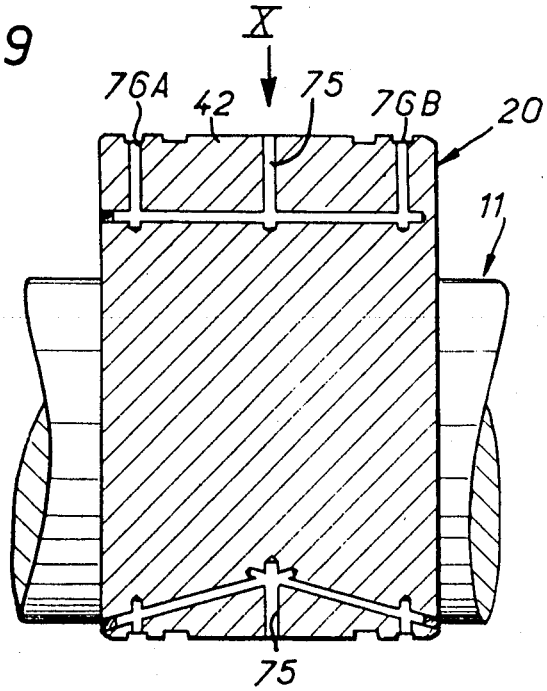
FIG. 9 is a view in axial section of this eccentric bearing surface, taken along the line IX—IX of FIG. 8.
Figure 10:
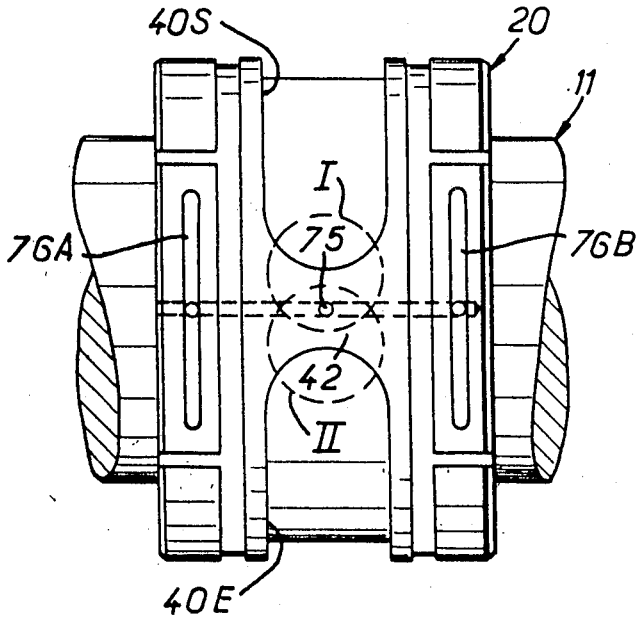
FIG. 10 is a plan view of this eccentric bearing surface looking in the direction of the arrow X of FIG. 9.

In order to attenuate these variations, as illustrated by FIGS. 8 to 10, at the surface of each of the change-over bosses 42 comprised by the eccentric bearing surface 20 of the shaft 11, into the central zone of such a boss, opens a conduit 75, coupled by internal conduits to two balancing cavities 76A, 76B elongated circumferentially on each side of the boss considered at the periphery of the bearing surface 20.

In FIG. 8, the relative position of the eccentric bearing surface 20 and of the distribution ring 21 corresponds to the instant, hereinafter known as the change-over instant, at which the shaft 11 rotating in the direction of the arrow F, one of the radial passages 44 of the distribution ring 21 is momentarily isolated both from the high-pressure inlet cavity 40E of the eccentric bearing surface 20 and from the low-pressure outlet cavity 40S of this bearing surface. The opening 75 and the cavities 76A, 76B are then subjected to a pressure intermediate between the high pressure and the low pressure.

In FIG. 10 there has been shown in broken lines I and II the relative layout of this radial passage 44 at the instants on each side of the change-over instant defined above, as a projection on the eccentric bearing surface 20 of the shaft 11.

As can be seen from FIG. 10, at the instant I preceding the change-over instant, the drilled hole 75 of the change-over boss 42 puts the cavities 76A, 76B which are associated with it into relation with the low-pressure outlet cavity 40S, which advantageously makes it possible to minimize the hydraulic thrust applied radially on the internal face of the ring, whereas precisely the corresponding cylinder-piston assembly unit 25 is not yet under pressure.

As the instant II following the change-over instant, the drilled hole 75 of the change-over boss 42 on the contrary puts the cavities 76A, 76B which are associated with it into connection with the high-pressure inlet cavity 40E which makes it possible to apply hydraulically on the internal surface of the ring a radial balancing thrust opposite to the mechanical thrust then applied on the external surface of this ring by the piston 27 of the cylinder-piston assembly unit 25, the supply of which has just given rise to the change-over concerned.

It will of course be understood that the present invention is not restricted to the forms of embodiment described and illustrated, but includes any alternative form of construction and or combination of their various parts.

What I claim is:

1. A rotary hydraulic machine comprising a casing, a shaft mounted for rotation in said casing, said shaft having an eccentric bearing surface intermediate its ends, a plurality of cylinder-piston assembly units disposed radially of and spaced around and exerting radial thrust toward said bearing surface, means individually oscillatingly mounting each of said assembly units on said casing about an axis substantially parallel to said shaft so that the cylinders and pistons of the cylinder-piston assembly units reciprocate relative to each other in a predetermined order upon rotation of said shaft, inlet and outlet passageways disposed in said shaft parallel to the axis thereof for circulating hydraulic fluid through said machine, angularly spaced inlet and outlet cavities in said shaft in communication with said inlet and outlet passageways respectively and opening onto said bearing surface, protruding change-over zones formed on said bearing surface effectively separating said inlet and outlet cavities from each other, and a distribution ring received on said bearing surface cooperating with said change-over zones and disposed between said bearing surface and said cylinder-piston assembly units, said distribution ring having a plurality of generally radial passages each facing and communicating with one of said cylinder-piston assembly units and also communicating alternately with said inlet and outlet cavities, and means permitting eccentric circular movement of said distribution ring while preventing its rotation with said bearing surface on said shaft comprising at least one annular plate arranged around said shaft and adjacent to said distribution ring member, there being a plurality of arcuate guiding openings in said annular plate and a corresponding plurality of guiding pin means in contact therewith, said pin means being fixed relative to one of said casing and distribution ring.

2. A rotary hydraulic machine according to claim 1, wherein said annular plate is fixed to said distribution ring and said guiding pin means are fixed on said casing.

3. A rotary hydraulic machine according to claim 1, wherein said means for oscillatingly pivotally mounting said cylinder-piston assembly units comprises a part cylindrical wall on the respective cylinders of said units and rotating in said casing member.

4. A rotary hydraulic machine according to claim 1, further comprising duct means opening onto a central region of said change-over zones on said bearing surface, there being two circumferentially extending balancing cavities along the periphery of said bearing surface one on each side of said change-over zones.

5. A rotary hydraulic machine according to claim 1, wherein there is provided on the inner periphery of said distribution ring a circumferential flaring of said passages.

6. A rotary hydraulic machine as claimed in claim 1, further comprising resilient means associated with each cylinder-piston assembly unit for urging said pistons toward said distribution ring.

7. A rotary hydraulic machine according to claim 1, wherein the outer peripheral surface of said distribution ring is part spherical.

8. A rotary hydraulic machine according to claim 1, wherein one end of said shaft is received in said casing with the end face thereof opposite a wall of said casing, a passageway extending along said shaft from said end face and communicating between the space defined between said shaft end face and said casing wall and another part of the interior of said casing remote from said end wall.

9. A rotary hydraulic machine according to claim 1, wherein said guiding pin means are mounted on said distribution ring member and said annular plate is secured relative to said casing for preventing rotation of said annular plate.

10. A rotary hydraulic machine according to claim 9 wherein said annular plate includes backing plate means for retaining said guiding pin means axially relative to said arcuate guiding openings.

11. A rotary hydraulic machine according to claim 1 wherein said means for oscillatingly pivotally mounting said cylinder-piston assembly units comprise a pair of trunnions pivotally mounting each of the units.

12. A rotary hydraulic machine according to claim 11, there being notches spaced around the periphery of said annular plate in which said trunnions are disposed.

13. A rotary hydraulic machine according to claim 1 wherein another annular plate substantially identical to the said annular plate is disposed around said shaft on the other side of said eccentric bearing surface from said first mentioned annular plate.

14. A rotary hydraulic machine according to claim 13, further comprising shoulder bearing means defined on said casing member adjacent to and axially outwardly of said annular plate members for contact therewith, spacing spring means urging said annular plates into contact with their respective shoulder bearing means, and rod members disposed between said annular plates and receiving said spacing spring means thereon.

15. A rotary hydraulic machine according to claim further comprising two transverse annular grooves provided along the interface between said bearing surface and said distribution ring and disposed on each side of radial passages in said distribution ring.

16. A rotary hydraulic machine according to claim 15, wherein said annular grooves are disposed on the inner periphery of said distribution ring member.

* * * * *